US011650615B2

(12) United States Patent
Sone

(10) Patent No.: US 11,650,615 B2
(45) Date of Patent: May 16, 2023

(54) SYSTEM AND METHOD FOR VOLTAGE GENERATION

(71) Applicant: Synaptics Japan GK, Tokyo (JP)

(72) Inventor: Yasuhiko Sone, Tokyo (JP)

(73) Assignee: Synaptics Japan GK, Tokyo (JP)

( * ) Notice: Subject to any disclaimer, the term of this patent is extended or adjusted under 35 U.S.C. 154(b) by 0 days.

(21) Appl. No.: 17/387,699

(22) Filed: Jul. 28, 2021

(65) Prior Publication Data

US 2021/0356983 A1 Nov. 18, 2021

Related U.S. Application Data

(62) Division of application No. 15/876,503, filed on Jan. 22, 2018, now Pat. No. 11,092,991.

(30) Foreign Application Priority Data

Jan. 24, 2017 (JP) ..... 2017-10039

(51) Int. Cl.
*G05F 3/26* (2006.01)

(52) U.S. Cl.
CPC ..... *G05F 3/267* (2013.01)

(58) Field of Classification Search
CPC ..... G05F 3/267; G05F 3/225; G05F 3/245
See application file for complete search history.

(56) References Cited

U.S. PATENT DOCUMENTS 5,488,289 A * 1/1996 Yeung ..... G06G 7/24 327/346
5,646,517 A * 7/1997 Belot ..... G05F 3/267 323/907
2007/0176591 A1 8/2007 Kimura
2016/0266590 A1 9/2016 Ura
2016/0349786 A1 12/2016 Fronczak et al.

FOREIGN PATENT DOCUMENTS

CN 102981546 A 3/2013

OTHER PUBLICATIONS

Okuda, Y. et al., "A Trimming-Free CMOS Bandgap-Reference Circuit with Sub-1-V-Supply Voltage Operation", 2007 Symposium on VLSI Circuits Digest of Technical papers, IEEE, Jun. 2007, pp. 96-97 (2 pages).
La Spina, L., "Characterization and AIN Cooling of Thermally Isolated Bipolar Transistors", Doctoral Dissertation, Delft University of Technology, The Netherelands, Jul. 1, 2009 (154 pages).

* cited by examiner

*Primary Examiner* — Son T Le
*Assistant Examiner* — Adam S Clarke
(74) *Attorney, Agent, or Firm* — Ferguson Braswell Fraser Kubasta PC

(57) ABSTRACT

A voltage generator circuitry includes first to third bipolar transistors having commonly-connected base electrodes, first and second current mirror circuitries, first and second differential amplifiers; a first resistor; and a current-voltage conversion circuitry. The first current mirror circuitry supplies currents to the first to third bipolar transistors and to the current-voltage conversion circuitry. The second current mirror circuitry supplies currents to the first to third bipolar transistors, and s to the current-voltage conversion circuitry. The first and second differential amplifiers control the first and second current mirror. The current-voltage conversion circuitry converts a sum current of the first and second currents into an output voltage.

20 Claims, 6 Drawing Sheets

SYSTEM AND METHOD FOR VOLTAGE GENERATION

CROSS REFERENCE

This application is a divisional of and claims the benefit of priority under 35 U.S.C. § 120 to U.S. patent application Ser. No. 15/876,503, filed on Jan. 22, 2018, which claims priority of Japanese Patent Application No. 2017-10039, filed on Jan. 24, 2017. All mentioned U.S. patent applications and international applications are incorporated by reference herein in their entirety.

TECHNICAL FIELD

The present disclosure relates to a voltage generator circuitry, more particularly; to a technique applicable to a voltage generator circuitry configured to generate a reference voltage with high accuracy for a power supply voltage lower than the bandgap voltage.

BACKGROUND ART

Low voltage operation is one issue of mobile devices in view of reduction in the power consumption and advance in the semiconductor manufacturing process, in which, in many implementations, the allowed maximum power supply voltage has been reduced due to the scaling of semiconductor devices. A bandgap voltage reference, which is often used as a reference voltage generator of an analog-digital conversion circuitry and a DC-DC converter circuitry, is a circuit component which determines the accuracy in the entire system, and therefore a bandgap voltage reference is typically configured to achieve high accuracy.

In various implementations, obstacles against high accuracy include the offset of an error amplifier and non-linearity of temperature property resulting from bipolar transistors. Hence, there is a need to reduce these issues in reference voltage generator circuitry.

In general, a reference voltage generator circuitry using a bandgap voltage of semiconductor is configured to cancel the temperature dependence by adding together a PTAT (proportional to absolute temperature) component of a voltage or current, which increases proportionally to the absolute temperature, and a CTAT (complementary proportional to absolute temperature) component of a voltage or current, which decreases proportionally to the absolute temperature, with the proportionality factors adjusted. A component for which the temperature dependency is canceled is commonly abbreviated to ZTAT, and the PTAT, CTAT and ZTAT current components may be referred to as IPTAT, ICTAT and IZTAT, respectively.

A highly-accurate reference voltage generator circuitry configured to operate on a power supply voltage lower than the bandgap voltage of silicon and exclude the effect of the offset voltage of an error amplifier is disclosed in Yuichi Okuda et al., "A Trimming-Free CMOS Bandgap-Reference Circuit with Sub-1-V-Supply Voltage Operation", 2007 Symposium on VLSI Circuits Digest of Technical papers, IEEE, June 2007, pp. 96-97, which is referred to as Okuda, hereinafter.

SUMMARY

In one or more embodiments, a voltage generator circuitry includes first, second, and third bipolar transistors having commonly-connected base electrodes, first and second current mirror circuitries, first and second differential amplifiers, a first resistor, and a current-voltage conversion circuitry. The second bipolar transistor is connected in series to the first resistor. The first current mirror circuitry supplies the collector currents to the first to third bipolar transistors, and supplies a first current to the current-voltage conversion circuitry.

The second current mirror circuitry supplies base currents to the first to third bipolar transistors and also supplies a second current to the current-voltage conversion circuitry. The first and second differential amplifiers control the first and second current mirror circuitries so that the potentials on the collector electrodes of the first to third bipolar transistors are equal to each other. The current-voltage conversion circuitry converts the sum current of the first and second currents into an output voltage.

In the present application, the term "equal" or "same" does not mean to be mathematically strictly equal or same, but means there may be an industrially acceptable error. Similarly, the term "proportional" and "complementary proportional" do not mean that the proportional factor is mathematically strictly constant; there may be an industrially acceptable error.

DETAILED DESCRIPTION

Figure 6:
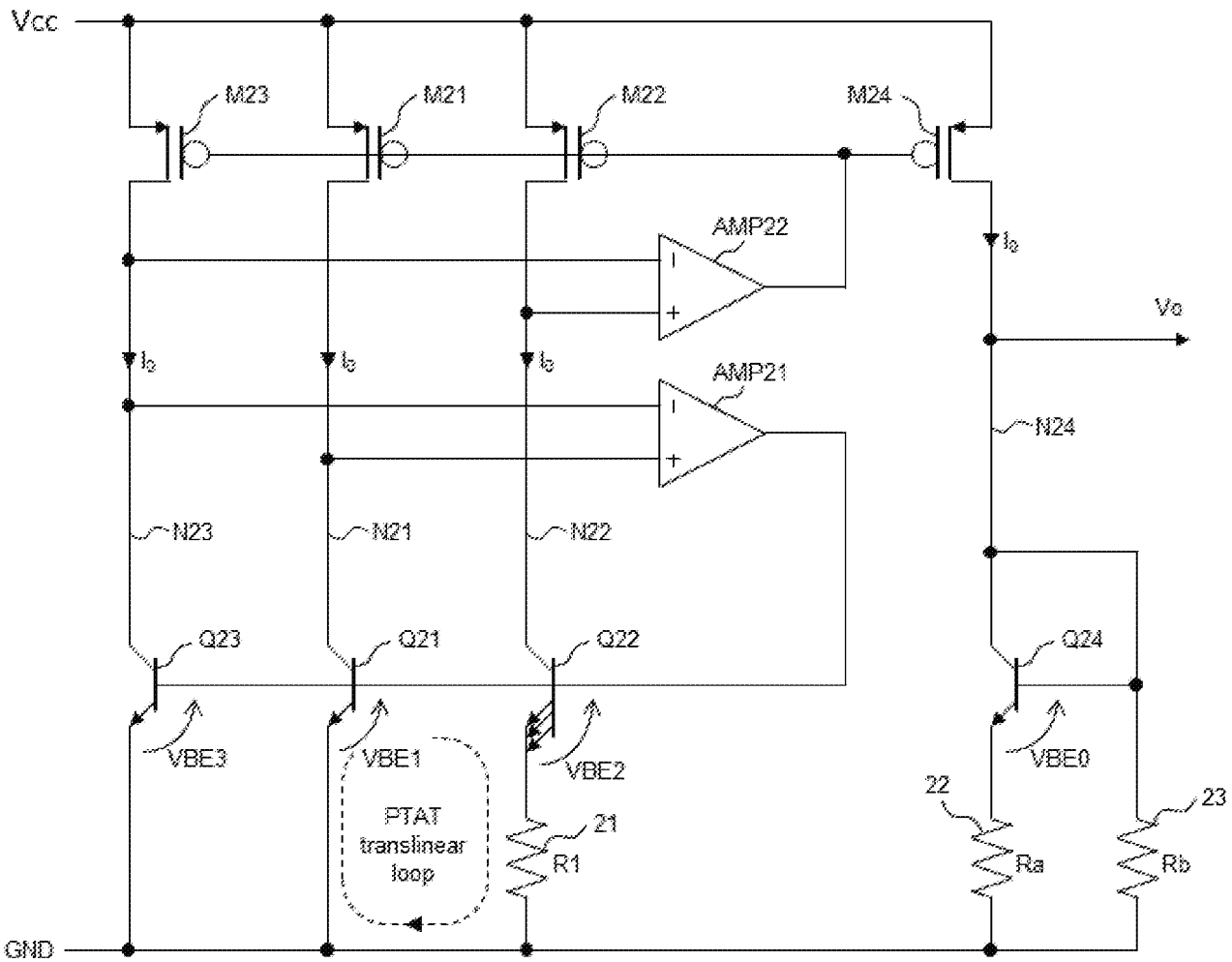
FIG. 6 PRIOR ART
FIG. 6 is a circuit diagram illustrating an example of a conventional voltage generator circuitry.

FIG. 6 illustrates a reference voltage generator circuitry disclosed by Okuda. The disclosed reference voltage generator circuitry includes first to fourth bipolar transistors Q21 to Q24, first to fourth P-channel MOS transistors M21 to M24, which constitute a current mirror circuitry, first and second differential amplifiers AMP21 and AMP22, which each function as an error amplifier, and three resistors 21, 22 and 23.

The resistances of the resistors 21, 22 and 23 are hereinafter referred to as R1, Ra and Rb, respectively. In the figures (FIGS. 1 and 3 to 6) of the present application, the reference numerals attached to the resistors denote the resistor elements themselves and the symbols starting with "R" disposed nearby denote the resistances of the resistor elements. There may be a case where different resistor elements have the same resistance; however, this does not mean that these resistor elements have mathematically strictly the same resistance, permitting an error as long as the function of the circuitry is achieved.

The first to fourth bipolar transistors Q21 to Q24 are connected in series to the first to fourth P-channel MOS transistors M21 to M24, respectively, between the power supply supplying a power supply voltage Vcc and the circuit ground having the ground level (GND); the connection nodes are hereinafter referred to as first to fourth nodes N21 to N24, respectively. The first, third and fourth bipolar transistors Q21, Q23 and Q24 are have the same size and the second bipolar transistor Q22 is N times the size of that of the first, third and fourth bipolar transistors Q21, Q23 and Q24, where N is a positive number larger than one. Accordingly, the current density per unit area of the second bipolar transistor Q22 is one $N^{th}$ of that of the first bipolar transistor Q21. The emitter electrodes of the first and third bipolar transistors Q21 and Q23 are connected to the circuit ground, and the emitter electrode of the second bipolar transistor Q22 is connected to the circuit ground via the resistor 21. The fourth bipolar transistor Q24 is diode-connected with the collector and base electrodes short-circuited. The emitter electrode of the fourth bipolar transistor Q24 is connected to the circuit ground via the resistor 22 and the base electrode is connected to the circuit ground via the resistor 23.

The differential input terminals of the first differential amplifiers AMP21 are connected to the first node N21 and the third node N23, respectively, and the output terminal is connected to the base electrodes of the first to third bipolar transistors Q21 to Q23. The differential input terminals of the second differential amplifiers AMP22 are connected to the second node N22 and the third node N23, respectively, and the output terminal is connected to the gate electrodes of the first to fourth P-channel MOS transistors M21 to M24, which constitute the current mirror circuitry.

Since the base electrodes of the first to third bipolar transistors Q21 to Q23 are short-circuited and receive the same voltage from the first differential amplifier AMP21, expression (1) holds:

$$V_{BE1}=V_{BE2}+I_0 \cdot R1=V_{BE3} \tag{1}$$

In general, the collector current $I_c$ of a bipolar transistor is represented with the base-emitter voltage $V_{BE}$ by expression (2):

$$I_c = I_s\left(\exp\frac{q}{kT}V_{BE}\right) \tag{2}$$

The respective parameters recited in expressions (2) are as follows:

$I_s$: the backward saturation current k: the Boltzmann constant ($1.38\times10^{-23}$ J/K)

q: the elementary electric charge ($1.6\times10^{-19}$ C)

T: the absolute temperature

The collector currents $I_C$ ($I_C=I_0$) of the first to fourth bipolar transistors Q21 to Q24 are controlled by the first to fourth P-channel MOS transistors M21 to M24, which constitute the current mirror circuitry, so that the same collector currents $I_C$ flow through the first to fourth bipolar transistors Q21 to Q24. the base-emitter voltages $V_{BE1}$ and $V_{BE2}$ of the first and second bipolar transistors Q21 and Q22 are obtained by solving expression (2) for the base-emitter voltage, as represented with the collector current $I_0$ by expressions (3) and (4) given below:

$$V_{BE1} = \frac{kT}{q}\ln\frac{I_0}{I_S} \tag{3}$$

-continued $$V_{BE2} = \frac{kT}{q}\ln\frac{I_0/N}{I_S} \tag{4}$$

As the second bipolar transistor Q22 is N times the size of that of the first bipolar transistor Q21, the current density per unit area of the second bipolar transistor Q22 is one $N^{th}$ of that of the first bipolar transistor Q21, as understood from expression (4).

The collector currents $I_0$ are proportional to $\Delta V_{BE}$ ($\Delta V_{BE}=V_{BE1}-V_{BE2}$) as is understood from the following expression (5), which is obtained by solving expression (1) for the collector currents $I_0$:

$$I_0 = \frac{V_{BE1}-V_{BE2}}{R1} = \frac{\Delta\nabla_{BE}}{R1} = \frac{1}{R1}\cdot\frac{kT}{q}\ln\left(\frac{I_0}{I_S}\frac{I_S}{I_0/N}\right) = \frac{1}{R1}\cdot\frac{kT}{q}\ln N \tag{5}$$

By substituting expressions (3) and (4), it is understood that the collector current $I_0$ is proportional to the absolute temperature T. As thus discussed, the collector currents $I_0$ are PTAT currents proportional to the absolute temperature.

One of the currents $I_0$ is supplied to the fourth bipolar transistor Q24 by the fourth P-channel MOS transistor M24 of the current mirror circuitry. Since the fourth bipolar transistor Q24 is diode-connected, the positive temperature coefficient property of the potential difference across the resistor 22 and the negative temperature coefficient property of the base-emitter voltage $V_{BED}$ can be cancelled by selecting the resistances of the resistors 22 and 23, and this allows outputting a reference voltage $V_0$ with reduced temperature dependence.

The current output from the fourth P-channel MOS transistor M24 is divided into currents flowing through the resistors 22 and 23, and therefore satisfies the following expression (6).

$$I_0 = \frac{\nabla_0}{Rb} + \frac{V_0-\nabla_{BE0}}{Ra} \tag{6}$$

By solving expression (6) for the output voltage $V_0$, the following expression (7) is obtained:

$$V_0 = \frac{Rb}{Ra+Rb}\times(Ra\cdot I_0 + V_{BE0}) \tag{7}$$

By substituting the collector current $I_0$, which satisfies $I_0=\Delta V_{BE}/R1$ as understood from expression (5), into expression (7), the following expression (8) is obtained:

$$V_0 = \frac{Rb}{Ra+Rb}\times\left(\frac{Ra}{R1}\cdot\Delta V_{BE} + V_{BE0}\right) \tag{8}$$

As thus discussed, it is possible to match and cancel the positive temperature coefficient of $\Delta V_{BE}$ and the negative temperature coefficient of $V_{BE0}$ by appropriately selecting the ratio Ra/R1 of the resistances R1 and Ra of the resistors 21 and 22. The output voltage $V_0$ can be reduced to or below the bandgap voltage of silicon by adjusting the ratio (Rb/Ra+Rb) of the resistance Rb of the resistor 23 to the sum of the resistances Ra and Rb of the resistors 22 and 23, and the power supply voltage $V_{CC}$ can be reduced down to about 1V by setting the output voltage $V_0$ to a sufficiently low voltage (e.g., 0.7V).

Additionally, the offset voltages of the differential amplifiers used as the error amplifiers AMP21 and AMP22 do not influence the PTAT currents, because the error amplifiers AMP21 and AMP22 are not included in the PTAT translinear loop which controls the PTAT currents.

Accordingly, this circuitry is a highly-accurate reference voltage generator circuitry configured to operate on a voltage lower than the bandgap voltage of silicon, free of influence of the offset voltages of the error amplifiers.

In various embodiments, the accuracy in such a highly-accurate reference voltage generator circuitry may be further improved. For example, in various embodiments, the temperature property of the base-includes a non-linear term as well as a first order CTAT term, which is complementary proportional to the absolute temperature. In contrast, the collector currents $I_0$ and $\Delta V_{BE}$ ($\Delta V_{BE}=V_{BE1}-V_{BE2}$) are exactly proportional to the absolute temperature (PTAT) as is understood from the above-mentioned expression (5). Accordingly, the non-linear term of the temperature property of the base-emitter voltage $V_{BE0}$ is not cancelled by the PTAT currents generated based on $\Delta V_{BE}$ ($\Delta V_{BE}=V_{BE1}-V_{BE2}$), although the first order term of is cancelled. A detailed discussion is given below.

The relationship between the collector current $I_c$ and the base-emitter voltage $V_{BE}$ in a bipolar transistor is as given by expression (2). Here, as known in the art, the backward saturation current $I_S$ is given by expression (9):

$$I_S = bT^{4+m}\exp\frac{-Eg}{kT} \tag{9}$$

See Behzad Razavi, "Design of Analog CMOS Integrated Circuits", McGraw-Hill Education, September 2003, United States, p. 382, expression (11.8).

The parameters recited in expression (9) are listed in the following:

b: the proportionality constant m: the temperature coefficient of the mobility μ, where $\mu=\mu_0 T^m$.

Eg: the energy bandgap

For silicon, m≈−3/2 and Eg=1.12 eV.

Expression (10) is obtained by substituting expression (9) into expression (2) and solving the resultant expression for the base-emitter voltage $V_{BE}$:

$$\begin{aligned} V_{BE} &= \frac{kT}{q}\ln\frac{I_C}{I_S} \\ &= \frac{kT}{q}\ln I_C - \frac{kT}{q}\ln I_S \\ &= \frac{kT}{q}\ln I_C - \frac{kT}{q}\ln\left(bT^{4+m}\exp\frac{-Eg}{kT}\right) \\ &= \frac{kT}{q}\ln I_C - \frac{kT}{q}\ln bT^{4+m} + \frac{kT}{q}\frac{Eg}{kT} \\ &= Vg + \frac{kT}{q}\ln\frac{I_C}{bT^{4+m}} \end{aligned} \tag{10}$$

In this expression, Eg/q is replaced with the bandgap voltage Vg (Vg=Eg/q).

When the collector current $I_C$ of the bipolar transistor is generated as a PTAT current given by expression (5), expression (12) is obtained by substituting $I_C$=CT into expression (10), where C is a proportional constant given by expression (11):

$$I_C = CT \tag{11}$$

here, $$\begin{aligned} C &= \frac{1}{R1}\cdot\frac{k}{q}\ln N \\ V_{BE} &= Vg + \frac{kT}{q}\ln\frac{CT}{bT^{4+m}} \\ &= Vg + \frac{kT}{q}\ln\frac{C}{b} - (3+m)\frac{kT}{q}\ln T \end{aligned} \tag{12}$$

As thus discussed, it is understood that the temperature dependence of the base-emitter voltage $V_{BE}$ involves the third term which is non-linear, in involves the third term which is non-linear, in addition to Vg, which is the zero-th order term free of the temperature dependence, and the first order term k/q·ln(c/b)·T, which is complementary proportional to the absolute temperature.

In contrast, the collector currents $I_0$ and $\Delta V_{BE}$ ($\Delta V_{BE}=V_{BE1}-V_{BE2}$) are exactly proportional to the absolute temperature (PTAT), as described above. Therefore, the non-linear term of the temperature dependence of the base-emitter voltage $V_{BE}$ cannot be cancelled, although the first order term is effectively cancelled.

In one embodiment, a voltage generator circuitry includes first to third bipolar transistors having commonly-connected base electrodes, first and second current mirror circuitries, first and second differential amplifiers, a first resistor and a current-voltage conversion circuitry.

In one or more embodiments, the first and third bipolar transistors have the same emitter size and the second bipolar transistor has an emitter size larger than that of the first bipolar transistor. The second bipolar transistor is connected in series to the first resistor.

In one or more embodiments, the first current mirror circuitry is configured to supply the same transistors, and supply a first current proportional to the collector currents to the current-voltage conversion circuitry. The second current mirror circuitry is configured to supply the same base currents to the first to third bipolar transistors, and supply a second current proportional to the base currents to the current-voltage conversion circuitry. The first and second differential amplifiers are configured to control the first and second current mirror circuitries so that the potentials on the collector electrodes of the first to third bipolar transistors are equal to each other.

The current-voltage conversion circuitry converts the sum current of the first and second currents into the output voltage to output the output voltage.

The voltage generator circuitry thus configured can operate on a power supply voltage lower than the bandgap voltage, exclude an influence of the offset voltage of an error amplifier, and output a highly-accurate output voltage, suppressing accuracy deterioration resulting from a non-linear term of the temperature property of a bipolar transistor.

The collector currents of the first to third bipolar transistors and the first current, which are output from the first current mirror circuitry, are PTAT currents proportional to the absolute temperature or ZTAT currents for which the first order CTAT term, which is complementary proportional to the absolute temperature, is cancelled. The collector currents of the first to third bipolar transistors are generated with the same principle as that of the voltage generator circuitry illustrated in FIG. 6, and this allows operation on a power supply voltage lower than the bandgap voltage and exclusion of influence of the offset voltage of error amplifiers; however, there still remains accuracy deterioration resulting from the non-linear term of the temperature property of the bipolar transistors. The base currents of the first to third bipolar transistors and the second current, which are output from the second current mirrors, have current levels depending on the non-linear term of the temperature property of these bipolar transistors. By appropriately setting circuit parameters, the non-linear term of the temperature property of the first current can be cancelled by that of the second current. This allows for a highly-accurate voltage generator circuitry which suppresses the accuracy deterioration resulting from the non-linear term of the temperature property of the bipolar transistors.

The voltage generator circuitry may be connected to first and second power supplies, one of which supplies a power supply voltage and the other acts as a circuit ground.

In one embodiment, the voltage generator circuitry further includes a second resistor connected between the collector electrode of the second bipolar transistor and the second power supply, a third resistor having the same resistance as the first resistor and connected between the collector electrode of the second bipolar transistor and the second power supply, and a fourth resistor have the same resistance as the second resistor and connected between the collector electrode of the third bipolar transistor and the second power supply.

The current-voltage conversion circuitry includes a fifth resistor having one terminal supplied with the first and second currents to output the output voltage and the other terminal connected to the second power supply.

This configuration allows for the above-described voltage generator circuitry by using three bipolar transistors.

The second to fourth resistors are connected in parallel between the collectors and emitters of the first to third bipolar transistors, respectively, and this allows CTAT currents, which are complementary proportional to the absolute temperature, to flow through the second to fourth resistors. Since a PTAT current, which is proportional to the absolute temperature, flows through the second bipolar transistor as is the case with the voltage generator circuitry illustrated in FIG. 6, the collector currents of the first to third bipolar transistors and the first current, which are output from the first current mirror circuitry, are ZTAT currents generated as the sum currents of the CTAT currents and PTAT currents. A non-linear term of the temperature property in the ZTAT currents may remain, although the first order term is cancelled. By supplying the sum current of one of the ZTAT currents, which includes the non-linear term, and the second current, which includes the non-linear term of the temperature property of the bipolar transistor, the non-linear term of the temperature property may be cancelled and thereby improving the accuracy.

In one embodiment, the voltage generator circuitry may be formed on a semiconductor substrate through an MOS transistor manufacturing process. In this case, each of the first and second current mirror circuitry may include a plurality of MOS transistors, and the first to third bipolar transistors may include parasitic bipolar transistors formed in the semiconductor substrate.

This allows for a highly-accurate voltage generator circuitry through an MOS transistor manufacturing process which does not include a bipolar transistor manufacturing process.

In one embodiment, each of the first and second bipolar current mirror circuitries includes a plurality of bipolar transistors disposed separately from the first to third bipolar transistors.

This allows for a highly-accurate voltage generator circuitry through a bipolar transistor process or a Bi-CMOS process.

The voltage generator circuitry recited may be connected to first and second power supplies.

In one embodiment, the current-voltage conversion circuitry may include a sixth resistor, a seventh resistor and a fourth bipolar transistor which is diode-connected. The fourth bipolar transistor and the sixth resistor may be connected in series between the second power supply and a node supplied with the first and second currents to output the output voltage, and connected in parallel to the seventh resistor.

This allows for a highly-accurate voltage generator circuitry by using three resistor elements, while the number of the included resistor elements is reduced.

Since a PTAT current, which is proportional to the absolute temperature, flows through the second bipolar transistor as is the case with the voltage generator circuitry illustrated in FIG. 6, PTAT currents having the same current level flow through the first and third bipolar transistors due to the operation of the first current mirror circuitry. The first current, which is output from the first current mirror, is also a PTAT current. The current-voltage conversion circuitry is basically configured as illustrated in FIG. 6, and this allows cancelling the temperature coefficient of the fourth bipolar transistor by appropriately setting the ratio of the resistances of the first and sixth resistors. Additionally, it is possible to cancel the non-linear term current by using the sum current of the PTAT current including the non-linear term and the second current which includes the non-linear term of the temperature property of a bipolar transistor, as the input current of the current-voltage conversion circuitry.

In another embodiment, a voltage generator circuitry is connected to first and second power supplies, and configured to output an output voltage. One of the first and second power supplies supplies a power supply voltage and the other acts as a circuit ground.

The voltage generator circuitry includes first to third bipolar transistors having commonly-connected base electrodes; first to fourth transistors constituting a first current mirror circuitry, first and second differential amplifiers, and a first resistor.

The first and third bipolar transistors have the same emitter size and the second bipolar transistor have N times the emitter size of that of the first bipolar transistor, where N is a positive number larger than one.

The first transistor and the first bipolar transistors are connected in series at a first node between the first and second power supplies, and the second bipolar transistor and the first resistor are connected in series to each other and connected in series to the second transistor at a second node between the first and second power supplies, while the third transistor and the third bipolar transistor are connected in series at a third node between the first and second power supplies.

The first differential amplifier have differential input terminals connected to two of the first to third nodes, and controls the first current mirror circuitry so that the first to third transistors respectively output first currents having the same current level.

The voltage generator circuitry further includes fifth and sixth transistors which constitute a second current mirror circuitry and the fifth transistor has A times the size of that of the sixth transistor, where A is a positive number.

The second differential amplifier having one differential input terminal connected to one of the two nodes of the first to third nodes, and the other differential input connected to the node other than the two nodes of the first to third nodes. The second differential amplifier controls the second current mirror circuitry so that second currents are supplied to the commonly-connected base electrodes of the first to third bipolar transistors via the fifth transistor, and a third current having a current level of one $A^{th}$ of the second currents is output from the sixth transistor.

The voltage generator circuit converts the sum current of the third current and a fourth current output from the fourth transistor into the output voltage and outputs the output voltage.

The voltage generator circuitry thus configured can operate on a power supply voltage lower than the bandgap voltage, exclude an influence of the offset voltage of an error amplifier, and generate a highly-accurate output voltage, suppressing accuracy deterioration resulting from a non-linear term of the temperature property of a bipolar transistor.

The first current, which is output from the first current mirror circuitry, is a PTAT current proportional to the absolute temperature or a ZTAT currents for which the first order CTAT term, which is complementary proportional to the absolute temperature, is cancelled. In this case, the fourth current has a current level equal to that of the first current or a current level which is proportional to that of the first current and dependent on the mirror ratio of the first current mirror circuitry. The first and fourth currents are generated with the same principle as that of the voltage generator circuitry illustrated in FIG. 6, and this allows operation on a power supply voltage lower than the bandgap voltage and exclusion of influence of the offset voltage of error amplifiers; however, there still remains accuracy deterioration resulting from the non-linear term of the temperature property of the bipolar transistors. Meanwhile, the third current has a current level depending on the non-linear term of the temperature property of the bipolar transistor. By appropriately designing the constant A, the non-linear term of the temperature property of the fourth current can be cancelled by the non-linear term of the temperature property of the third current. This allows for a highly-accurate voltage generator circuitry which suppresses the accuracy deterioration resulting from the non-linear term of the temperature property of the bipolar transistors.

In one embodiment, the voltage generator circuitry may further include a second resistor connected between the first node and the second power supply, a third resistor have the same resistance as the second resistor and connected between the second node and the second power supply, a fourth resistor have the same resistance as the second resistor and connected between the third node and the second power supply, and a fifth resistor connected between the output of the fourth transistor and the second power supply.

This configuration allows for a highly-accurate voltage generator circuitry by using three bipolar transistors.

The second to fourth resistors are connected in parallel between the collectors and emitters of the first to third bipolar transistors, respectively, and this allows CTAT currents, which are complementary proportional to the absolute temperature, to flow through the second to fourth resistors. Since a PTAT current, which is proportional to the absolute temperature, flows through the second bipolar transistor as is the case with the voltage generator circuitry illustrated in FIG. 6, the outputs of the first current mirrors are ZTAT currents generated as the sum currents of the CTAT currents and PTAT currents. Since the output of the fourth transistor, which is included in the fourth current mirror, is therefore a ZTAT current, the output of the fourth transistor is converted into the output voltage with the fifth resistor. There remains a non-linear term of the temperature property with respect to this ZTAT current, although the first order term is cancelled. By applying the third current, which includes the non-linear term of the temperature dependence of the bipolar transistor, to the fifth resistor via the sixth transistor of the second current mirror circuitry, it is possible to cancel the non-linear term current and thereby improve the accuracy.

In one embodiment, the voltage generator circuitry may be formed on a semiconductor substrate through an MOS transistor manufacturing process. In this case, the first to sixth transistors may include MOS transistors and the first to third bipolar transistors may include parasitic bipolar transistors formed in the semiconductor substrate.

This allows for a highly-accurate voltage generator circuitry through an MOS transistor manufacturing process which does not include a bipolar transistor manufacturing process.

In one embodiment, the first to sixth transistors may include bipolar transistors.

This allows for a highly-accurate voltage generator circuitry through a bipolar transistor process or a Bi-CMOS process.

In one embodiment, the voltage generator circuitry may further include a sixth resistor, a seventh resistor and a fourth bipolar transistor which is diode-connected.

The fourth bipolar transistor and the sixth resistor may be connected in series and connected in parallel to the seventh resistor between the output of the fourth transistor and the second power supply.

This allows for a highly-accurate voltage generator circuitry by using three resistor elements, while the number of the included resistor elements is reduced.

Since a PTAT current, which is proportional to the absolute temperature, flows through the second bipolar transistor as is the case with the voltage generator circuitry illustrated in FIG. 6, PTAT currents having the same current level flow through the first and third bipolar transistors due to the operation of the first current mirror circuitry. The output of the fourth transistor, which is included in the first current mirror, is also a PTAT current. The output of the fourth transistor is connected to a circuitry basically configured similarly to that illustrated in FIG. 6, and this allows cancelling the temperature coefficient of the fourth bipolar transistor by appropriately setting the ratio of the resistances of the first and sixth resistors. The operation thus described is similar to that of the circuitry illustrated in FIG. 6, in which the first order term of the temperature property is cancelled and there still remains the non-linear term. By adding the third current, which includes the non-linear term of the temperature property of a bipolar transistor, to the current which flows through the current-voltage conversion circuitry, in which the fourth bipolar transistor and the sixth resistor are connected in series and connected in parallel to the seventh resistor, via the sixth transistor of the second current mirror circuitry, it is possible to cancel the non-linear term current and thereby improve the accuracy.

A further detailed description is given of various embodiments in the following.

First Embodiment

Figure 1:
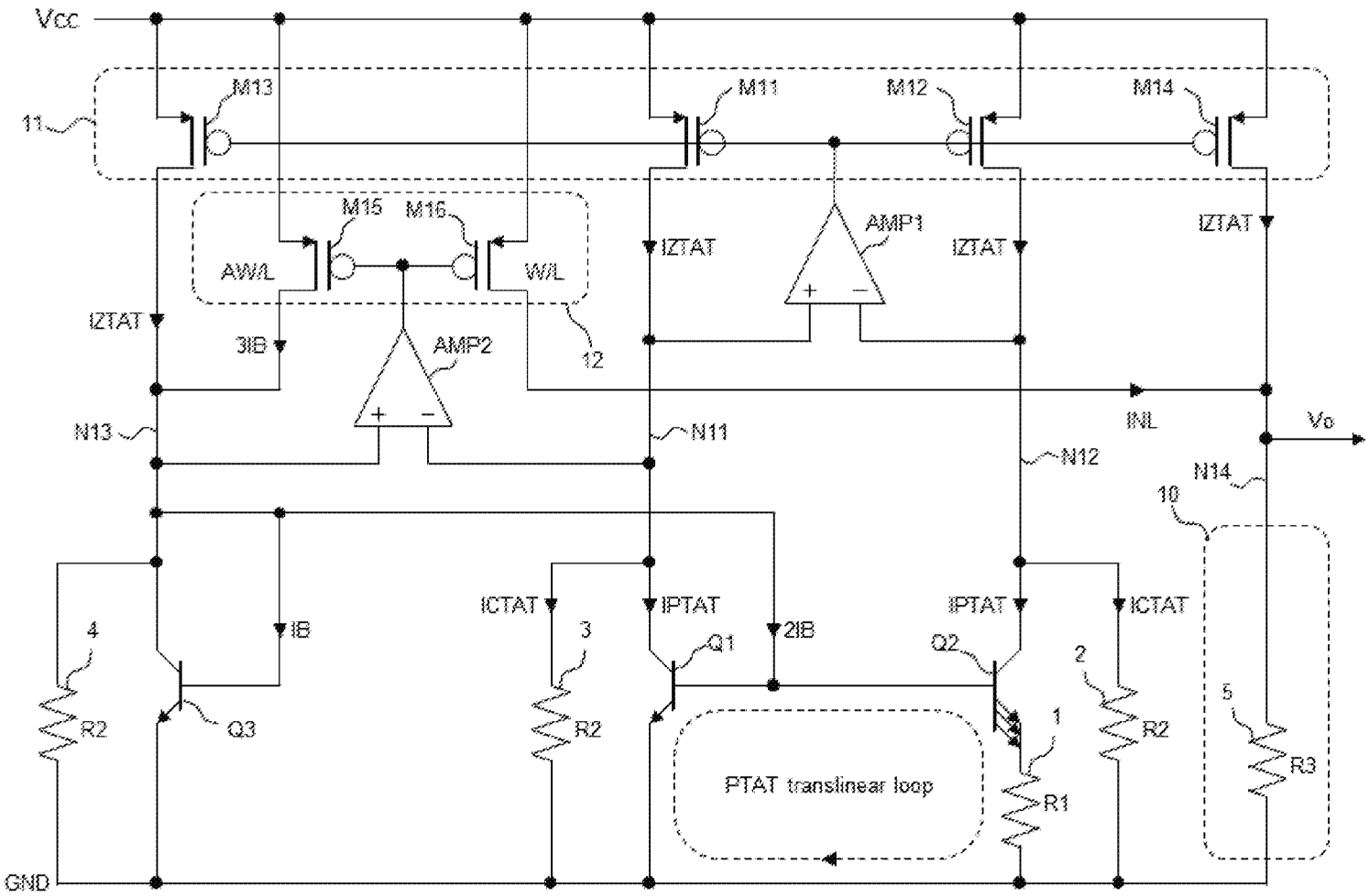
FIG. 1 is a circuit diagram illustrating a configuration example of a voltage generator circuitry according to one or more embodiments.

FIG. 1 is a circuit diagram illustrating a configuration example of a voltage generator circuitry in a first embodiment.

The voltage generator circuitry includes bipolar transistors Q1 to Q3 having commonly-connected base electrodes, current mirror circuitries 11, 12, differential amplifiers AMP1, AMP2, which function as error amplifiers, a resistor 1, and a current-voltage conversion circuitry 10.

The bipolar transistors Q1 and Q3 have the same emitter size and the bipolar transistor Q2 have an emitter size larger than that of the bipolar transistor Q1, for example, N times the emitter size of that of the bipolar transistor Q1, where N is a positive number larger than one. The bipolar transistor Q2 is connected in series to the resistor 1.

The current mirror circuitry 11 is configured to supply the same collector currents to the bipolar transistors Q1 to Q3, and also supply a first current proportional to the corrector currents to the current-voltage conversion circuitry 10. The current mirror circuitry 12 is configured to supply the same base currents IB to the bipolar transistors Q1 to Q3 and supply a second current INL proportional to the base currents to the current-voltage conversion circuitry 10. The differential amplifiers AMP1 and AMP2 are configured to control the current mirror circuitries 11 and 12 so that the collector electrodes of the bipolar transistors Q1 to Q3 have the same potential.

The current-voltage conversion circuitry 10 converts the sum current of the first current and the second current INL into an output voltage Vo and outputs the output voltage Vo.

The voltage generator circuitry thus configured can operate on a power supply voltage lower than the bandgap voltage, exclude an influence of the offset voltages of the error amplifiers (the differential amplifiers AMP1 and AMP2), and generate the output voltage Vo with high accuracy, suppressing accuracy deterioration resulting from the non-linear term of the temperature property of the bipolar transistors.

The corrector currents of the bipolar transistors Q1 to Q3 and the first current, which are output from the current mirror circuitry 11, are ZTAT currents IZTAT generated by canceling the PTAT currents having a level proportional to the absolute temperature with the first order CTAT term which is complementary proportional to the absolute temperature.

The collector currents of the bipolar transistors Q1 to Q3 are generated with the same principle as that of the voltage generator circuitry illustrated in FIG. 6. Since the output voltage Vo is obtained as the product of the current level of the ZTZT current IZTAT output from the transistor M14 and the resistance R3 of the resistor 5, the output voltage Vo can be set to a voltage lower than the bandgap voltage (for example, about 0.7V for silicon) by appropriately selecting the resistor 5. This allows the voltage generator circuitry to operate on a power supply voltage lower than the bandgap voltage. Additionally, as illustrated in FIG. 1, the influence of the offset voltage of the differential amplifier AMP1 is excluded, since the PTAT translinear loop does not include the differential amplifier AMP1, which functions as an error amplifier. Furthermore, the first current (IZTAT), which is the output current of the current mirror circuitry 11, potentially involves accuracy deterioration resulting from the non-linear term of the temperature property of the bipolar transistors, as is the case with the voltage generator circuitry illustrated in FIG. 6.

In contrast, the base currents IB of the bipolar transistors Q1 to Q3 and the second current INL, which are output from the current mirror circuitry 12, have current levels including the non-linear term of the temperature property of the bipolar transistors. By appropriately designing the circuit parameters, the non-linear term of the temperature property of the first current IZTAT and that of the second current INL can be cancelled. This allows for a voltage generator circuitry to be configured to generate a highly-accurate output voltage, suppressing accuracy deterioration resulting from the non-linear term of the temperature property of the bipolar transistors.

The voltage generator circuitry illustrated in FIG. 1 further includes a resistor 2 connected between the collector electrode of the bipolar transistor Q2 and the circuit ground, which has the ground level GND, a resistor 3 connected between the collector electrode of the bipolar transistor Q1 and the circuit ground, and a resistor 4 connected between the collector electrode of the bipolar transistor Q3 and the circuit ground. The resistors 2, 3 and 4 have the same resistance R2.

The current mirror circuitry 11 includes MOS transistors M11 to M14. The MOS transistors M11 to M14 have the same dimensions, that is, the same channel length L and the same channel width W, and therefore output the same currents IZTAT. The current mirror circuitry 12 includes MOS transistors M15 and M16 and has a mirror ratio of A:1. The MOS transistor M15 has A times the size of that of the MOS transistor M16, that is, the same channel length L as the MOS transistor M16 and a channel width AW, which is A times as wide as that of the MOS transistor M16, and therefore the second current INL output from the MOS transistor M16 has a current level of one $A^{th}$ of that of the current output from the MOS transistor M15.

The current-voltage conversion circuitry 10 includes a resistor 5 having one terminal supplied with the first and second currents to output the output voltage Vo and the other connected to GND.

In this configuration, the number of the included bipolar transistors is three.

The resistors 2, 3 and 4 are connected in parallel between the collectors and emitters of the bipolar transistors Q1 to Q3, respectively, and this allows CTAT currents, which are complementary proportional to the absolute temperature, to flow through the resistors 2, 3 and 4. Since a PTAT current having a current level proportional to the absolute temperature flows through the bipolar transistor Q2 as is the case with the voltage generator circuitry illustrated in FIG. 6, the collector currents of the bipolar transistors Q1 to Q3 and the first current, which are output from the current mirror circuitry 11, are ZTAT currents obtained as the sums of the CTAT currents the PTAT current. The first order term of the temperature property of these ZTAT currents is cancelled, while there still remains a non-linear term.

The output current of the MOS transistor M15 of the current mirror circuitry 12, which supplies the base currents IB of the bipolar transistors Q1 to Q3, is 3·IB, while the second current INL output from the MOS transistor M16, which has the size of one $A^{th}$, is 3·IB/A. The second current INL, which is proportional to the base currents IB of the bipolar transistors Q1 to Q3, includes a non-linear term of the temperature property of the bipolar transistors.

In this embodiment, the non-linear term current is cancelled to improve the accuracy by supplying the sum current of a ZTAT current including the non-linear term and the second current INL including the non-linear term as the input current of the current-voltage conversion circuitry 10.

The voltage generator circuitry of the first embodiment may be integrated in an integrated circuit formed on a semiconductor substrate of silicon or the like by using a publically known semiconductor device manufacturing technology, but not limited to this. When the bipolar transistors Q1 to Q3 are implemented as parasitic bipolar transistors formed in the semiconductor substrate, a CMOS (complementary metal-oxide-semiconductor field effect transistor) device manufacturing technology which does not include a bipolar transistor process may be used.

Figure 2:
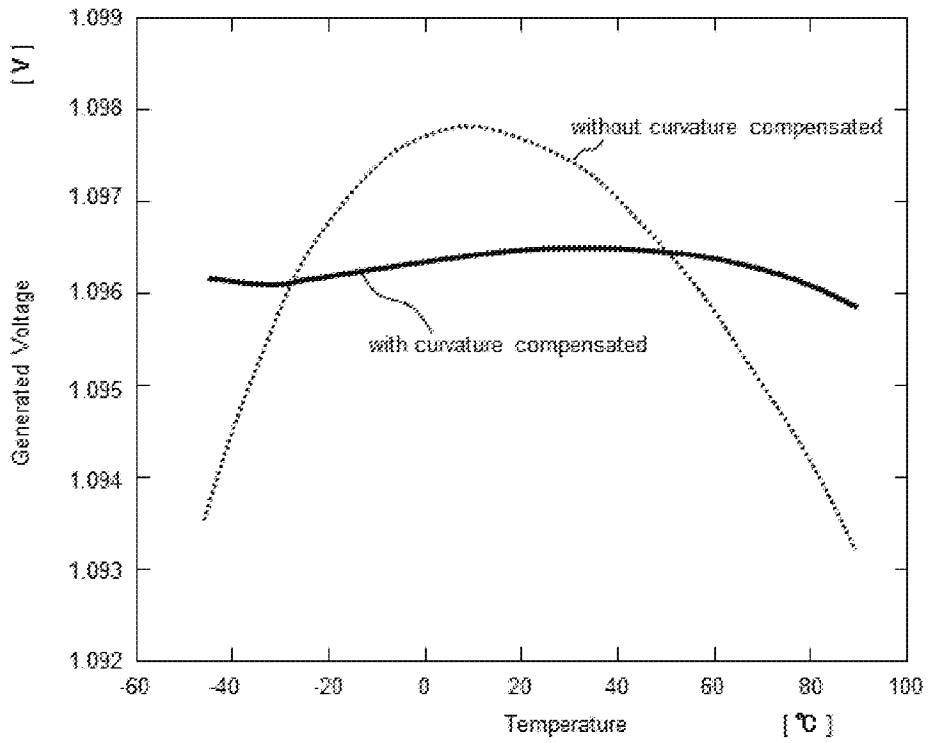
FIG. 2 is a graph illustrating the temperature property of the output voltage generated by the voltage generator circuitry according to one or more embodiments.

FIG. 2 is a graph illustrating an example of the temperature property of the output voltage generated by the voltage generator circuitry in this embodiment.

In this graph, the horizontal axis represents the temperature in Celsius and the vertical axis represents the output voltage generated by the voltage generator circuitry. The broken line indicated by the legend "without curvature compensated" illustrates the temperature property of the output voltage of the conventional voltage generator circuitry illustrated in FIG. 6, and the solid line indicated by the legend "with curvature compensated" illustrates the temperature property of the output voltage of the voltage generator circuitry in this embodiment.

The curve of the temperature property of the output voltage generated by the conventional voltage generator circuitry is convex upward, and, in one example, the output voltage varies in a variation range of about 3.5 mV for the temperature range from about −40° to 80° C.

The curve of the temperature property of the output voltage generated the voltage generator output voltage generated the voltage generator circuitry in this embodiment is generally flat, and in one example, the width of the variation range of the output voltage is reduced to about 0.5 mV for the temperature range from −40° to 80° C.

A further detailed description is given below of the operation principle of the voltage generator circuitry in this embodiment.

As described above, the temperature dependence of the base-emitter voltage $V_{BE}$ of a bipolar transistor includes the third term which is non-linear, as well as a zero-$^{th}$ term Vg, which does not depend on the absolute temperature, and a first order term k/q·ln(c/b)·t, which is complementary proportional to the absolute temperature, as indicated by expression (12). Meanwhile, as is understood from expression (5), the corrector currents $I_0$ and $\Delta V_{BE}$ ($\Delta V_{BE}=V_{BE1}-V_{BE2}$) are exactly proportional to the absolute temperature in the voltage generator circuitry illustrated in FIG. 6, and therefore the non-linear term of the temperature dependency of the base-emitter voltage $V_{BE}$ cannot be cancelled, while the first order term can be cancelled.

The same principle applies to the fact that there still remains a non-linear term of the temperature dependency of the ZTAT currents IZTAT in the voltage generator circuitry in the first embodiment, while the term of the temperature dependency of the ZTAT currents IZTAT is the same as the third term of expression (12).

When a Tayler expansion is performed on this non-linear term at an expansion point $T_0$, that is, when the third term of expression (12) is expanded in a Tayler series at a base point $T=T_0$, expression (13) is obtained which represents the terms of the second and higher terms:

$$-(3+m)\frac{kT_0}{q}\left\{\frac{1}{2}\left(\frac{T-T_0}{T_0}\right)^2-\frac{1}{6}\left(\frac{T-T_0}{T_0}\right)^3\cdots\right\} \tag{13}$$

where it holds:

$$-(3+m)\frac{kT_0}{q}\times\frac{1}{2}<0 \tag{14}$$

Since the coefficient of the second order term is negative as indicated by expression (14), it is understood that the property of the non-linear term of the PTAT currents is mainly dominated in accordance with a second-order curve (a parabola curve) which is convex upward. This fact is also supported by the broken line indicated by the legend "without curvature compensated" in FIG. 2, which illustrates the temperature property of the output voltage of the conventional voltage generator circuitry.

Next, a discussion is given of the temperature dependence of the base current $I_B$. The base current $I_B$ of a bipolar transistor can be represented by the expression (15):

$$I_C=I_B\times\beta_F(T) \tag{15}$$

where $\beta_F$ is the current amplification ratio and $I_C$ is the collector current.

It is known that the temperature property of the current amplification ratio $\beta_F$ of a bipolar transistor is represented by expression (16):

$$\beta_F(T)\propto\exp\left(-\frac{\Delta Eg(N_E)}{kT}\right) \tag{16}$$

where $\Delta Eg(N_E)$ is a constant which represents the bandgap narrowing effect in the emitter and can be determined by the impurity concentration $N_E$ of the emitter, free of dependence on the absolute temperature. See Luigi La Spina, "Characterization and AlN cooling of thermally isolated bipolar transistors", Doctoral Dissertation of Delft University of Technology, the first day of July 2009, Netherland, pp. 22-23.

When expression (15) is rewritten for simplicity with a temperature-independent positive constant defined by: $\alpha=\Delta Eg(N_E)/k$, the temperature property of the base current $I_B$ for a constant corrector current $I_C$ can be represented by expression (17):

$$I_B=I_C/\beta_F(T)\propto\exp\left(\frac{\alpha}{T}\right) \tag{17}$$

By expanding the temperature property of the base current $I_B$ into a Tayler series at a base point $T=T_0$, expression (18) is obtained:

$$\exp\left(\frac{\alpha}{T}\right)=\exp\left(\frac{\alpha}{T_0}\right)-\frac{\alpha}{T_0^2}\exp\left(\frac{\alpha}{T_0}\right)(T-T_0)+\frac{\alpha(2T_0+\alpha)}{T_0^4}\exp\left(\frac{\alpha}{T_0}\right)\frac{(T-T_0)^2}{2} \tag{18}$$

where it holds:

$$\frac{\alpha(2T_0+\alpha)}{T_0^4}\exp\left(\frac{\alpha}{T_0}\right)>0 \tag{19}$$

Since the coefficient of the second order term is positive as indicated by expression (19), it is understood that the property of the non-linear term of the base current $I_B$ is mainly dominated by a second-order curve which is convex downward.

The non-linear term included in the ZTAT currents IZTAT in the voltage generator circuitry of the first embodiment is mainly dominated by a second-order curve (a parabola curve) which is convex upward, as indicated by expression (13). Meanwhile, the second current INL, which is proportional to the base current $I_B$, includes a non-linear term mainly dominated by a second-order curve which is convex downward, which corresponds to the non-linear term of the temperature property of the bipolar transistor, as indicated by expression (18). Accordingly, by appropriately designing the mirror ratio A of the current mirror circuitry 12 so that the second order terms of the ZTAT current IZTAT and the second current INL coincide with each other, the second order terms of the ZTAT currents IZTAT and the second current INL are cancelled to compensate the second order term of the output voltage Vo, which is proportional to the sum of the ZTAT current IZTAT and the second current INL, as well as the zero-th and first order terms. This allows for a highly-accurate voltage generator circuitry to be configured to suppress accuracy deterioration resulting from a non-linear term of the temperature property of bipolar transistor.

Figure 3:
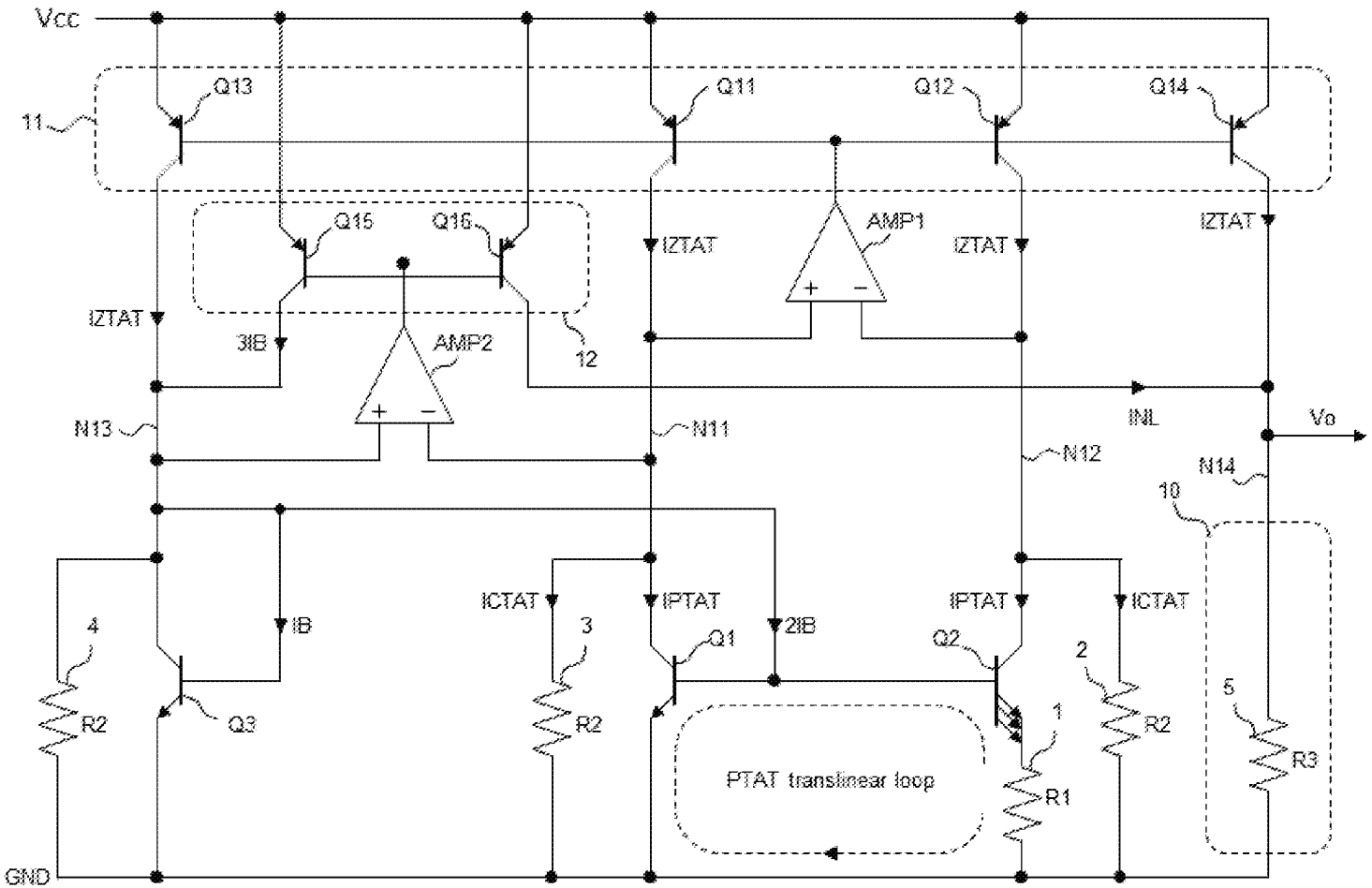
FIG. 3 is a circuit diagram illustrating an example of the voltage generator circuitry according to one or more embodiments.

FIG. 3 is a circuit diagram illustrating another configuration example of the voltage generator circuitry in the first embodiment.

The current mirror circuitries 11 and 12 may include bipolar transistors. In the voltage generator circuitry illustrated in FIG. 3, the current mirror circuitry 11 includes PNP bipolar transistors Q11 to Q14. The PNP bipolar transistors Q11 to Q14 have the same size, and therefore output currents IZTAT having the same current level. The current mirror circuitry includes PNP bipolar transistors Q15 and Q16 and has a mirror ratio of A:1. The PNP bipolar transistor Q15 has A times the emitter size of that of the PNP bipolar transistor Q16, and therefore the second current INL output from the PNP bipolar transistor Q16 has a current level of one $A^{th}$ of that output from the PNP bipolar transistor Q15.

The configuration and operation of the rest are similar to those of the voltage generator circuitry illustrated in FIG. 1, and no description thereof is given.

This configuration allows for a highly-accurate voltage generator circuitry of this embodiment through a bipolar transistor process or a Bi-CMOS process, excluding an MOS transistor fabrication process. In this case, the bipolar transistors Q1 to Q3 may be formed as normal NPN bipolar transistors in place of the parasitic bipolar transistors.

Second Embodiment

Figure 4:
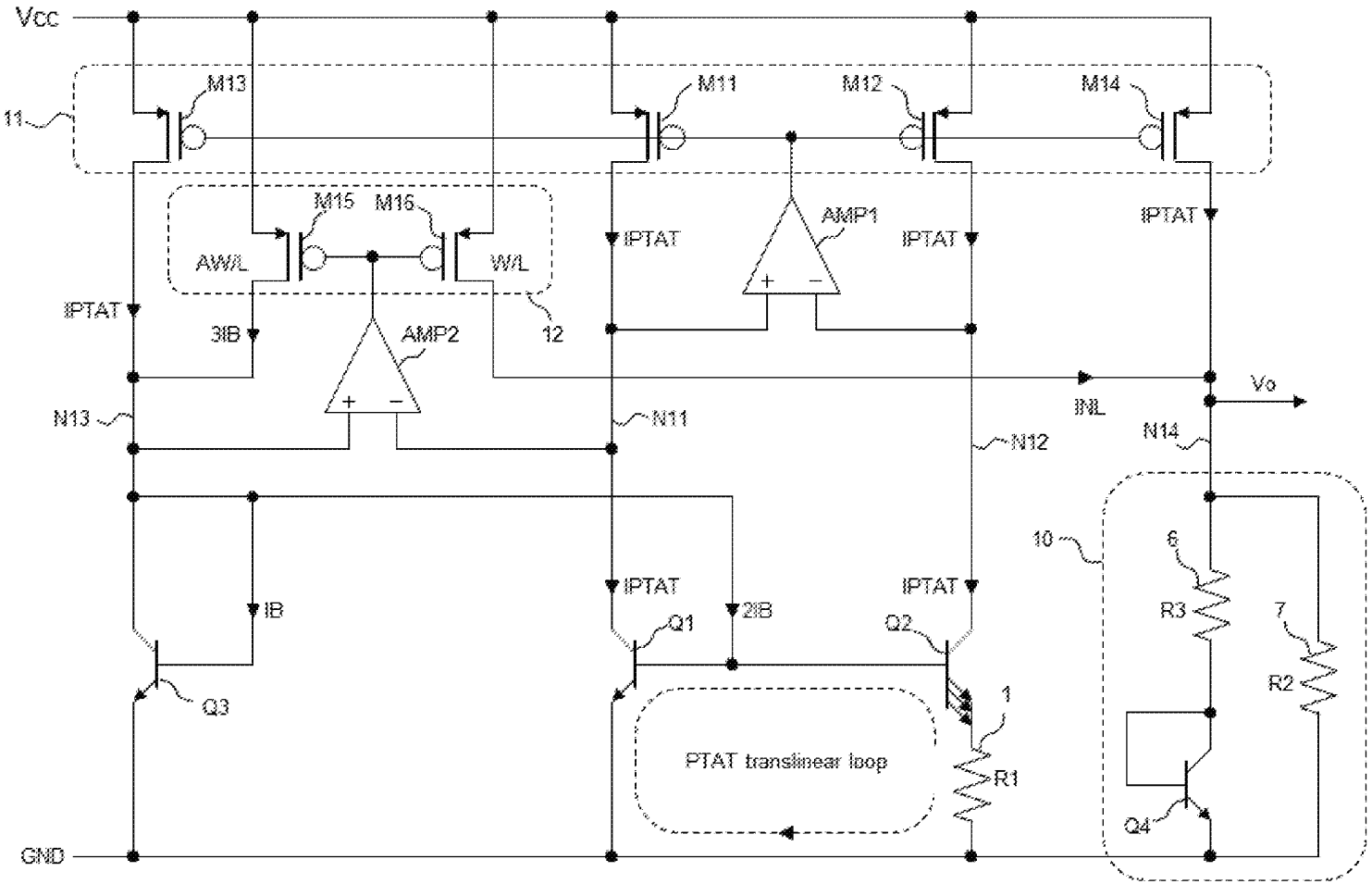
FIG. 4 is a circuit diagram illustrating an example of a voltage generator circuitry according to one or more embodiments.

FIG. 4 is a circuit diagram illustrating a configuration example of a voltage generator circuitry in a second embodiment.

Differently from the voltage generator circuitry of the first embodiment illustrated in FIG. 1, the resistors 2, 3 and 4 are omitted and the current-voltage conversion circuitry 10 is configured so that a diode-connected bipolar transistor Q4 and a resistor are connected in serial and in parallel to a resistor 7. The configuration of the rest is similar to that illustrated in FIG. 1 and no description thereof is given.

Similarly to the voltage generator circuitry of the first embodiment illustrated in FIG. 1, the voltage generator circuitry thus configured can operate on a power supply voltage lower than the bandgap voltage, exclude an influence of the offset voltages of an error amplifiers (differential amplifiers AMP1 and AMP2), and generate a highly-accurate output voltage Vo, suppressing accuracy deterioration resulting from a non-linear term of the temperature property of the bipolar transistors.

As is the case with the voltage generator circuitry of the first embodiment illustrated in FIG. 1, the potentials on the nodes N11 to N13, which are equal to the base-emitter voltage of the bipolar transistors Q1 and Q3, are about 0.7V when the bipolar transistors Q1 to Q3 are formed of silicon. The output voltage Vo can be set to a voltage sufficiently lower than the bandgap voltage of silicon by appropriately selecting the resistances R1 and R3 of the resistors 1 and 3, and this allows an operation on a power supply voltage lower than the bandgap voltage (about 1.2V). Additionally, as illustrated in FIG. 4, the PTAP translinear loop does not include the differential amplifier AMP1, which functions as an error amplifier, and this eliminates an influence of the offset voltage.

Since the resistors 2, 3 and 4 are omitted, the current mirror circuitry 11 outputs PTAT currents (IPTAT) proportional to the difference $\Delta V_{BE}$ ($\Delta V_{BE}=V_{BE1}-V_{BE2}$) between the base-emitter voltages of the bipolar transistors Q1 and Q2, which have current levels proportional to the absolute temperature. Accordingly, the voltage generator circuitry of this embodiment generates the collector currents of the bipolar transistors Q1 to Q3 with the same principle as the voltage generator circuitry illustrated in FIG. 6. The collector currents of the bipolar transistors Q1 to Q3 and the first current, which are output from the current mirror circuitry 11, are PTAT currents IPTAT, which are proportional to the absolute temperature. Furthermore, the first current IPTAT output from the current mirror circuitry 11 potentially involves accuracy deterioration resulting from the non-linear term of the temperature property of the bipolar transistors, as is the case with the voltage generator circuitry illustrated in FIG. 6.

Meanwhile, the base currents IB of the bipolar transistors Q1 to Q3 and the second current INL, which are output from the current mirror circuitry 12, have current levels including the non-linear term of the temperature property of the bipolar transistors. By appropriately designing the circuit parameters, it is possible to cancel the non-linear term of the temperature property of the first current IPTAT and that of the second current INL. Accordingly, the voltage generator circuitry of the second embodiment can generate the output voltage Vo with high accuracy, suppressing accuracy deterioration resulting from the non-linear term of the temperature property of the bipolar transistors.

Additionally, the voltage generator circuitry of the second embodiment, in which the resistors 2, 3 and 4 are omitted, effectively suppresses the increase in the chip area, compared with the first embodiment.

Figure 5:
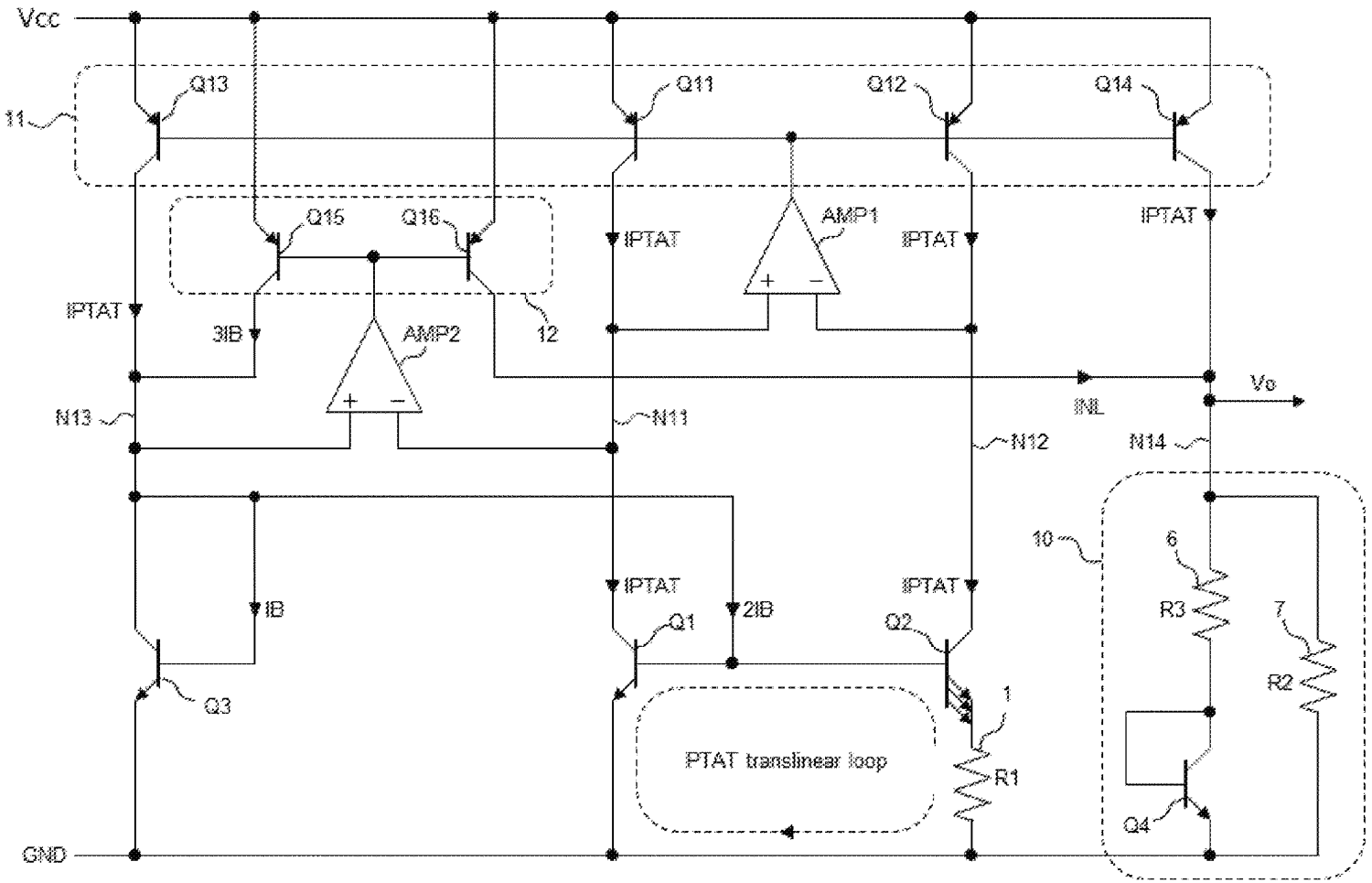
FIG. 5 is a circuit diagram illustrating an example of the voltage generator circuitry according to one or more embodiments.

FIG. 5 is a circuit diagram illustrating another configuration example of the voltage generator circuitry in the second embodiment.

The current mirror circuitries 11 and 12 may include bipolar transistors. In the voltage generator circuitry illustrated in FIG. 5, the current mirror circuitry 11 includes PNP bipolar transistors Q11 to Q14. The PNP bipolar transistors Q11 to Q14 have the same size and therefore output the currents IPTAT having the same current level. The current mirror circuitry 12 includes PNP bipolar transistors Q15 and Q16 and has a mirror ratio of A:1. The PNP bipolar transistor Q15 has A times the emitter size of that of the PNP bipolar transistor Q16, and therefore the second current INL output from the PNP bipolar transistor Q16 has a current level of one $A^{th}$ of that output from the PNP bipolar transistor Q15.

The configuration and operation of the rest are similar to those of the voltage generator circuitry illustrated in FIG. 4, and no description thereof is given.

This configuration allows for a highly-accurate voltage generator circuitry of this embodiment through a bipolar transistor process or a Bi-CMOS process, excluding an MOS transistor fabrication process. In this case, the bipolar transistors Q1 to Q3 may be formed as normal NPN bipolar transistors in place of the parasitic bipolar transistors.

Although various embodiments have been specifically described in the above, a person skilled in the art would appreciate the technologies disclosed in this disclosure may be implemented with various modification.

For example, the bipolar transistors may be selected from NPN type or PNP type and the MOS transistors may be selected from P-channel type or N-channel type, depending on the necessity. Although the mirror ratio of the current mirror circuitry 11 is described as 1:1 in the above-given description, this mirror ratio may be appropriately modified. Various design parameters may be appropriately modified, as long as the voltage generator circuitry is designed so as to cancel the second order component of the non-linear term of the output current of the MOS transistor M14 or the bipolar transistor Q14 of the current mirror circuitry 11 and the second order component of the non-linear term of the output current of the MOS transistor M16 or the bipolar transistor Q16 of the current mirror circuitry 12.

What is claimed is:

1. A voltage generator circuitry, comprising:

a first bipolar transistor, a second bipolar transistor, and a third bipolar transistor having commonly-connected base electrodes;

a first transistor, a second transistor, a third transistor and a fourth transistor constituting a first current mirror circuitry, the first transistor and the first bipolar transistor are connected in series at a first node between first and second power supplies, and the third transistor and the third bipolar transistor are connected in series at a third node between the first and second power supplies;

a first resistor connected in series with the second bipolar transistor and connected in series with the second transistor at a second node between the first and second power supplies;

a fifth transistor and a sixth transistor which constitute a second current mirror circuitry;

a first differential amplifier comprising differential input terminals connected to two of the first, second, and third nodes, and is configured to control the first current mirror circuitry to output first currents from the first transistor, the second transistor, and the third transistor;

a second differential amplifier comprising:

a first differential input terminal connected to at least one of the first node, the second node and the third node; and a second differential input terminal connected to a node other than the at least one of the first node, the second node, and the third node, the second differential amplifier is configured to control the second current mirror circuitry to supply a second current to the commonly-connected base electrodes of the first bipolar transistor, the second bipolar transistor, and the third bipolar transistor via the fifth transistor, and a third current output from the sixth transistor; and a voltage generator circuit configured to convert the third current and a fourth current into an output voltage.

2. The voltage generator circuitry according to claim 1, wherein:

the first and third bipolar transistors have a same emitter size, and the second bipolar transistor has an emitter size "N" times the emitter size of the first bipolar transistor, where "N" is a positive number larger than one.

3. The voltage generator circuitry according to claim 1, wherein the first differential amplifier is further configured to control the first current mirror circuitry to supply the first currents output from the first transistor, the second transistor, and the third transistor with a same current level.

4. The voltage generator circuitry according to claim 1, wherein the second current mirror circuitry is configured to provide the third current with a current level that is a fraction of the second current.

5. The voltage generator circuitry according to claim 1, further comprising:

a second resistor connected between the first node and the second power supply;

a third resistor connected between the second node and the second power supply;

a fourth resistor connected between the third node and the second power supply; and a fifth resistor connected between the output of the fourth transistor and the second power supply.

6. The voltage generator circuitry according to claim 5, wherein the third and fourth resistors have a same resistance.

7. The voltage generator circuitry according to claim 1, wherein the voltage generator circuitry is formed on a semiconductor substrate through a MOS transistor manufacturing process, the first to sixth transistors are MOS transistors, and the first to third bipolar transistors comprise parasitic bipolar transistors formed in the semiconductor substrate.

8. The voltage generator circuitry according to claim 1, wherein the first to sixth transistors comprise bipolar transistors.

9. The voltage generator circuitry according to claim 1, further comprising:

a sixth resistor;

a seventh resistor; and a fourth bipolar transistor which is diode-connected, and is connected in series with the sixth resistor and connected in parallel to the seventh resistor between the output of the fourth transistor and the second power supply.

10. The voltage generator circuitry according to claim 1, wherein the first power supply or the second power supply supplies a power supply voltage, and wherein the other one of the first and second power supplies acts as a circuit ground.

11. The voltage generator circuitry according to claim 1, wherein the fifth transistor has a size "A" times that of the sixth transistor, where "A" is a positive number.

12. A semiconductor device comprising:

a voltage generator circuitry, comprising:

a first bipolar transistor, a second bipolar transistor, and a third bipolar transistor having commonly-connected base electrodes;

a first transistor, a second transistor, a third transistor and a fourth transistor constituting a first current mirror circuitry, the first transistor and the first bipolar transistor are connected in series at a first node between first and second power supplies, and the third transistor and the third bipolar transistor are connected in series at a third node between the first and second power supplies;

a first resistor connected in series with the second bipolar transistor and connected in series with the second transistor at a second node between the first and second power supplies;

a fifth transistor and a sixth transistor which constitute a second current mirror circuitry;

a first differential amplifier comprising differential input terminals connected to two of the first, second, and third nodes, and is configured to control the first current mirror circuitry to output first currents from the first transistor, the second transistor, and the third transistor;

a second differential amplifier comprising:

a first differential input terminal connected to at least one of the first node, the second node and the third node; and a second differential input terminal connected to a node other than the at least one of the first node, the second node, and the third node, the second differential amplifier is configured to control the second current mirror circuitry to supply a second current to the commonly-connected base electrodes of the first bipolar transistor, the second bipolar transistor, and the third bipolar transistor via the fifth transistor, and a third current output from the sixth transistor; and a voltage generator circuit configured to convert the third current and a fourth current into an output voltage.

13. The semiconductor device according to claim 12, wherein:

the first and third bipolar transistors have a same emitter size, and the second bipolar transistor has an emitter size "N" times the emitter size of the first bipolar transistor, where "N" is a positive number larger than one.

14. The semiconductor device according to claim 12, wherein the first differential amplifier is further configured to control the first current mirror circuitry to supply the first currents output from the first transistor, the second transistor, and the third transistor with a same current level.

15. The semiconductor device according to claim 12, wherein the second current mirror circuitry is configured to provide the third current with a current level that is a fraction of the second current.

16. The semiconductor device according to claim 12, wherein the voltage generator circuitry further comprises:

a second resistor connected between the first node and the second power supply;

a third resistor connected between the second node and the second power supply;

a fourth resistor connected between the third node and the second power supply; and a fifth resistor connected between the output of the fourth transistor and the second power supply.

17. The semiconductor device according to claim 12, wherein the voltage generator circuitry is formed on a semiconductor substrate through a MOS transistor manufacturing process, the first to sixth transistors are MOS transistors, and the first to third bipolar transistors comprise parasitic bipolar transistors formed in the semiconductor substrate.

18. The semiconductor device according to claim 12, wherein the first to sixth transistors comprise bipolar transistors.

19. The semiconductor device according to claim 12, wherein the voltage generator circuitry further comprises:

a sixth resistor;

a seventh resistor; and a fourth bipolar transistor which is diode-connected, and is connected in series with the sixth resistor and connected in parallel to the seventh resistor between the output of the fourth transistor and the second power supply.

20. The semiconductor device according to claim 12, wherein the fifth transistor has a size "A" times that of the sixth transistor, where "A" is a positive number.

* * * * *